United States Patent [19]

Miyamoto

[11] 4,001,970

[45] Jan. 11, 1977

[54] CLOSABLE COUNTER DEVICE FOR VERTICAL WALL

[76] Inventor: Akio Miyamoto, 19-24, 2-chome, Nakaikegami, Octu, Tokyo, Japan

[22] Filed: Feb. 11, 1975

[21] Appl. No.: 549,037

[52] U.S. Cl. ..... 49/171

[51] Int. Cl.[2] ..... E06B 7/28

[58] Field of Search ..... 49/70, 171; 109/58.5

[56] References Cited

UNITED STATES PATENTS 1,576,656 3/1926 Honsinger ..... 49/171 X

FOREIGN PATENTS OR APPLICATIONS 226,332 12/1924 United Kingdom ..... 49/171

*Primary Examiner*—Kenneth Downey
*Attorney, Agent, or Firm*—Wenderoth, Lind & Ponack

[57] ABSTRACT

This invention relates to a closable counter device for a vertical wall structure such as a door of a house or an office or room in a building and more particularly to a closable counter device on a vertical wall such as a door adapted to conveniently communicate with a visitor or visitors or to deliver an article or articles therethrough in the condition of opening the counter device while the door is latched without imparting any discomfort to the visitor or visitors and in a safe manner in connection with prevention of crimes as well as in connection with prevention of privacy.

7 Claims, 6 Drawing Figures

CLOSABLE COUNTER DEVICE FOR VERTICAL WALL

BACKGROUND OF THE INVENTION

In the prior art, a vertical wall such as a door is usually provided with a peephole, or otherwise, with a small lens through a hole in the wall through which a visitor or vistors can be confirmed. Alternatively, the door is restrained from being fully opened by means of a chain device while it remains slightly open. however, such prior art devices have disadvantagously imparted discomfort to the visitor or visitors. The peephole or the small lens has a disadvantage in that one cannot communnicate with the visitor or visitors in a satisfactory manner (although it does prevent crimes in a safe manner), and the chain device cannot effectively prevent crimes because any slight opening will allow an invader to enter through the door broken by force and arms.

SUMMARY OF THE INVENTION

Accordingly, it is a principal object of the present invention to provide a folding or closable counter device for a vertical wall structure such as a door wherein one can satisfactorily communicate with a visitor or visitors or deliver an article or articles therethrough without imparting any discomfort to them and in a safe manner in connection with prevention of crimes as well as in connection with retaining privacy and which is adapted to be completely and easily folded or closed after use.

One of the most important features of the present invention is to provide a folding or closable counter device for a vertical wall structure such as a door comprising a rectangular frame mounted on said wall through an opening formed therein; a transparent plate mounted on said frame with said frame and said transparent plate defining a window therebetween at the lower portion of said frame; and a counter plate pivotally mounted on said frame and movable between a vertical position in which said counter plate closes said window in a locking relation with said frame inside said vertical wall and a horizontal position in which said window is open with said counter plate serving as a counter.

BRIEF DESCRIPTION OF THE DRAWING

The above and other objects and feature of the present invention will be apparent from the detailed description of preferred embodiment of the present invention with reference to the accompanying drawing in which.

DETAILED DESCRIPTION OF THE PREFERRED EMBODIMENTS

Figure 1:
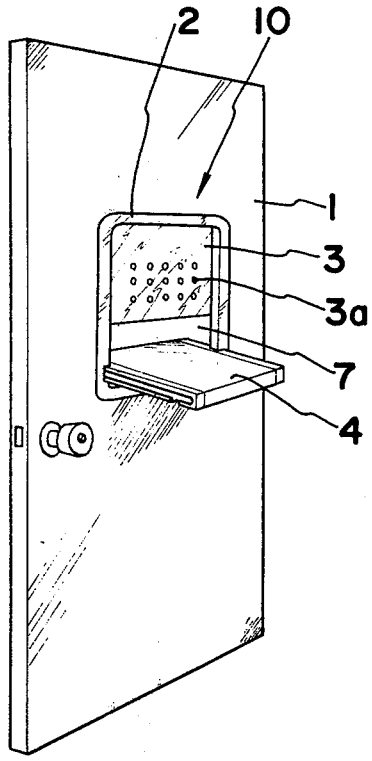
FIG. 1 is a perspective view of a counter device on a door while it is in the open condition.
Figure 2:
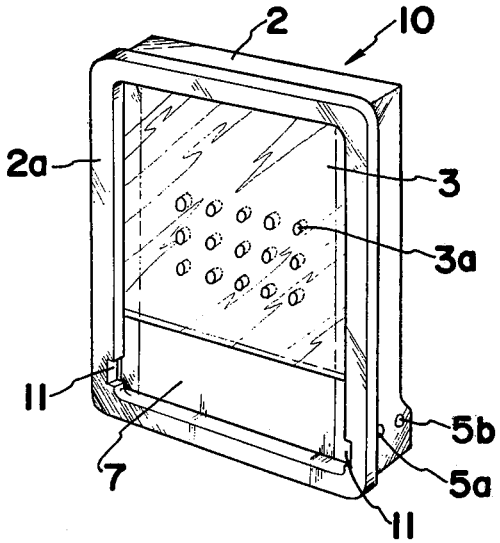
FIG. 2 is an enlarged perspective view of the counter device while it is in the closed condition.
Figure 3:
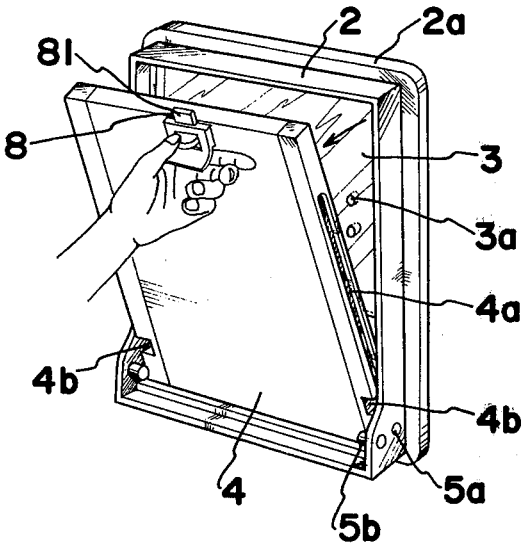
FIG. 3 is an enlarge perspective view of the counter device when it is about to be open.
Figure 4:
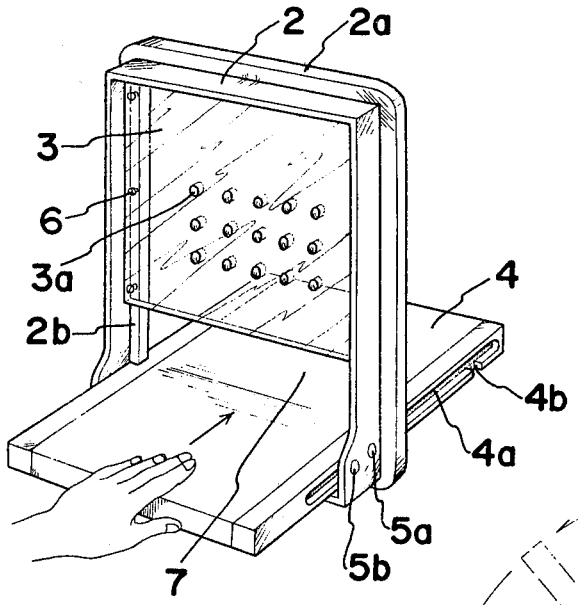
FIG. 4 is an enlarged perspective view of the counter device when it is slidable in the open condition.

Referring now to FIG. 1, an iron or wooden body of a door 1 has a closable counter device 10 mounted therein. The counter device 10 comprises a rectangular frame 2 composed of wood, iron or aluminium and having an outward flange 2*a* integrally formed on the outer periphery of the frame 2 as shown in FIG. 2. The frame 2 may be fitted into an opening in the door body 1 and attached thereto by means of screws (not shown). The device 10 also comprises a transparent plate 3 composed of glass or synthetic resin having a plurality of apertures 3*a* formed therein; said plate may be fitted into the frame 2 and attached to an inward flange 2*b* by means of screws 6 a window 7 is defined between the lower edge of the transparent plate 3 and the lower portion of the frame 1. The device 10 further comprises a counter plate 4 composed of wood, iron or aluminium and which has longitudinal grooves 4*a* formed in both sides thereof. The counter plate 4 is slidably mounted on the lower portion of the frame 2, with the longitudinal grooves 4*a* each receiving two pins 5*a* and 5*b* which are in turn secured to each of the inner vertical surfaces of the frame 2, so that the counter plate 4 is guidable along the pins by engagement of the latter with the grooves 4*a*. The pins 5*a* and 5*b* are shown to be spaced from each other so that the counter plate 4 can move in a stable manner. Transverse slots 4*b* are provided in the longitudinal grooves 4*a* at the points which are spaced from the edges of the grooves 4*a* by distance equaling the space between the pins 5*a* and 5*b* so that the pins 5*b* can extend through the slots 4*b* to be withdrawn from the grooves 4*a*. Thus, with the counter plate 4 pulled in a direction opposite to an arrow of FIG. 6 until the pins 5*a* engage the edges of the longitudinal grooves 4*a*, the counter plate 4 is pivotaly movable about the pins 5*a* so that it closes the window 7 together with the transparent plate 3. It should be noted that the pins 5*a* and 5*b* are disposed inside the door body 1 so that the counter plate is positioned interior of the door body 1. Thus, one outside the door cannot move the counter plate 4 toward the horizontal position thereof or the open condition of the window 7 while he is outdoors. The counter plate 4 may be provided with a latch 8 mounted on the inner edge of the counter plate 4. The latch 8 may comprise a latch body 81 retractably projected from the inner edge of the counter plate 4 by means of a spring 82 received in a recess 83 in the counter plate 4. The frame 2 may be provided with a locking piece 9 attached to the upper portion of the frame 2 so that it latches the counter plate to hold it in a close or vertical position by engaging it with the latch 8. It will be understood that a pair of guide grooves 11 in the inward flange 2*b* serve to stably guide the counter plate 4 in a horizontal position together with the pins 5*a* and 5*b*.

In operation, when one has a visit from a person, the counter plate 4 can be opened by disengaging the latch 8 with the locking piece and pivotally moving the counter plate 4 toward the horizontal position. As previously described, the counter plate 4 is slidably movable along the pins 5*a* and 5*b* in a stable manner. Thus, the transparent plate 3 is exposed so that the visitor can be confirmed therethrough and so that he can communicate with the visitor through the apertures 3*a* in the transparent plate 3. It will be noted that an article or articles having small dimensions such as postal matters, documents or the likes can be delivered through the window 7 while they are mounted on the slidable counter plate 4. It will be also noted that people can write, sign on or seal the delivered documents lying on the counter plate in a stable manner because it is held horizontal in position by the pins 5*a* and 5*b* and the guide grooves 11.

Figure 5:
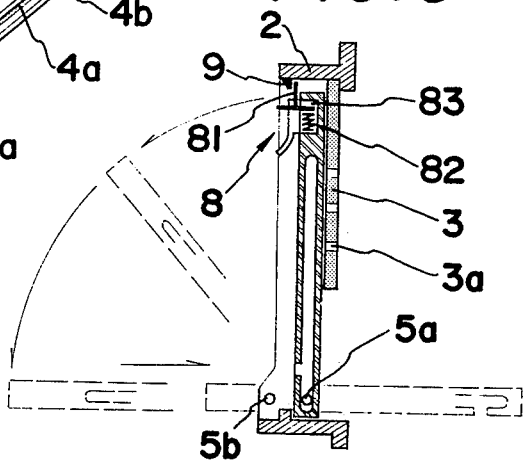
FIG. 5 is a vertically sectional view of the counter device while it is in the closed condition.

After required communication, business or delivery of the article or articles, the counter plate 4 may be pulled inward of the door 1 until the edges of the longitudinal grooves 4*a* engage the pins 5*a* and then be pivoted about the pins so that they may be raised as shown in FIG. 5 with the latch 8 engaged with the locking piece on the frame. Thus, the window 7 can be fully closed by the raised counter plate 4 so that unnecessary matters are never thrown indoors. It will be noted that the door may remain latched while the above acts are being made. Thus, with this device constructed within the door, a bill collector, a mailman or a drummer can promptly do his business without entering the house or room and without imparting any discomfort to him, which causes the business to be effective. Furthermore, since the door may be latched during business, a woman or a child can be safely protected from invaders. Thus, as soon as a man such as an importunate peddler or an apparently doubtful salesman by which one does not want to be visited is confirmed, the counter plate 4 can be closed so that the window 7 can be kept interrupted in a safe manner in connection with prevention or crimes.

Figure 6:
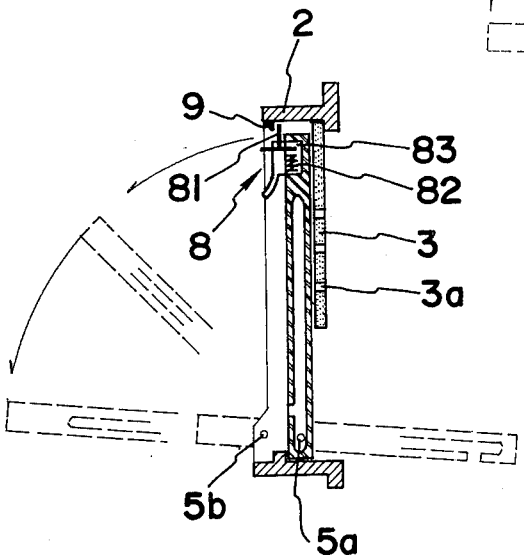
FIG. 6 is a vertically sectional view of another embodiment of a counter device when it is in the closed condition.

FIG. 6 shows a modification of the closable counter device 10 wherein the same numerals designate the same components. In this modification, the pins 5*a* are located at lower level than the pins 5*b*, with the result that the counter plate 4, when opened, is slidable downwardly outdoors. Thus, any visitor can easily write a document on the counter plate even though he is short.

Although some preferred embodiments of the present invention have been illustrated and described with reference to the accompanying drawing, it will be apparent that various changes and modifications may be made without departing from the spirit and scope of the present invention. For example, the counter plate 4 may be made of translucent material serving as a skylight. It should be understood that the present invention is intended to be defined only to the appended claim.

What is claimed is:

1. A closable counter apparatus for fitting in an opening through a vertical surface, said apparatus comprising:

a frame fitted into said opening and attached to said vertical surface;

a transparent plate mounted in said frame and spaced from one edge thereof, whereby a window opening between the edge of said plate spaced from said frame is defined;

at least two horizontal pins spaced from each other on each of the lower inside vertical side surfaces of said frame; and a counter plate within said frame having longitudinal grooves in said opposite sides thereof engaging said horizontal pins, said counter plate being pivotable vertically within said frame about said horizontal pins, whereby said window opening and said transparent plate are covered, and said counter plate being slidable horizontally along said pins within said longitudinal grooves when said counter plate is pivoted toward the horizontal about said pins, whereby said transparent plate is uncovered, said window opening is opened, and said counter plate provides a counter surface.

2. An apparatus as claimed in claim 1, wherein said transparent plate has a plurality of apertures therethrough.

3. An apparatus as claimed in claim 1, wherein said frame has an inner flange around the outer surface thereof, said flange having two oppositely positioned guide grooves therein through which said counter plate slides when said counter plate is slided horizontally along said horizontal pins.

4. An apparatus as claimed in claim 1, wherein said horizontal pins are horizontally level with each other.

5. An apparatus as claimed in claim 1, wherein one of said horizontal pins is at a level vertically lower than the other horizontal pin.

6. An apparatus as claimed in claim 1, wherein said longitudinal grooves in said counter plate also have transverse slots therein at the end adjacent said horizontal pins, said transverse slots being engageable with one of said horizontal pins when said counter plate is pivoted toward the horizontal, whereby said longitudinal groove is slidable along said horizontal pins when said counter plate is slided in the horizontal direction.

7. An apparatus as claimed in claim 1, wherein said counter plate is comprised of translucent material.

* * * * *